United States Patent [19]

Droge et al.

[11] Patent Number: 5,020,789

[45] Date of Patent: Jun. 4, 1991

[54] DRIVE UP TELLER MACHINE

[75] Inventors: David A. Droge, Charlotte; Jeffrey B. Lyerly; William E. Mott, both of Harrisburg; Lance W. Whitehead; Matthew G. Yenik, both of Charlotte, all of N.C.

[73] Assignee: International Business Machines Corporation, Armonk, N.Y.

[21] Appl. No.: 282,414

[22] Filed: Dec. 9, 1988

[51] Int. Cl.[5] ..... B65H 5/00

[52] U.S. Cl. ..... 271/225; 271/184; 271/185; 414/764; 414/767; 414/772; 414/776

[58] Field of Search ..... 271/225, 184, 185, 200, 271/2; 414/757, 764, 767, 772, 776, 777, 779, 782, 788.5, 788.6; 221/265, 264

[56] References Cited

U.S. PATENT DOCUMENTS

| | | | |
|---|---|---|---|
| 3,458,056 | 7/1969 | Stefan et al. . | |
| 3,550,811 | 12/1970 | Austin | 221/262 |
| 3,836,980 | 9/1974 | Grosswiller, Jr. et al. | 346/22 |
| 3,873,443 | 3/1975 | Cothran et al. | 271/184 X |
| 3,897,901 | 8/1975 | Grosswiller, Jr. et al. | 232/44 |
| 4,308,804 | 1/1982 | Guibord et al. | 109/24.1 |
| 4,355,711 | 10/1982 | Hirose | 194/4 C |
| 4,753,387 | 6/1988 | Fee et al. | 234/43.3 |
| 4,778,332 | 10/1988 | Byers et al. | 414/735 |

OTHER PUBLICATIONS

IBM Technical Disclosure Bulletin, vol. 2, No. 3, Oct. 1959, p. 7, "Document Feed", by E. M. Valehrach and G. Rosenquist.

*Primary Examiner*—David H. Bollinger
*Attorney, Agent, or Firm*—Karl O. Hesse

[57] ABSTRACT

A teller machine for drive up applications is disclosed. The machine has a safe with an access slot. The machine also has a user panel which has an opening that lies transverse to the slot. A document carrier is described which rotates documents around two different axes as it carries them between the slot and the opening to allow passage of the documents through both.

7 Claims, 7 Drawing Sheets

DRIVE UP TELLER MACHINE

BACKGROUND OF THE INVENTION

1. Field of the Invention

This invention relates to automatic teller machines which are used by members of the public in order to execute a wide variety of financial transactions at convenient locations and at any time of day. More specifically this invention relates to teller machines to be installed adjacent to driveways at financial institutions and operated from a car window. Such machines are designed to receive cash and checks, often contained within a deposit envelope and to issue money to the machine user. Inasmuch as these machines are unattended, their reliability of operation is important. Likewise the money to be issued or the money being deposited must be protected in a secure enclosure of some type.

2. Prior Art

In the prior art such machines are designed so that the envelope being deposited and the money being issued travel in the most direct path in order to achieve a high reliability of operation. For example, in U.S. Pat. No. 3,836,980 the slot into the deposit container is parallel to the opening in the teller machine user panel through which the user makes a deposit, allowing the deposited envelope to travel in a straight line without constricting corners or bends. Such design results in a machine which is relatively deep from front to back. The cash issuing mechanism usually operates in a like manner but in reverse, transporting money from a money container area to the user.

In teller machines mounted through a building wall or in the lobby of a financial institution, such depth is not necessarily objectionable. However, when the machine is to be mounted on an island between two drive up traffic lanes, the existing architectural designs of financial institutions places a constraint on the depth which the machine may have.

SUMMARY OF THE INVENTION

Advantages of the invention include simple document handling mechanism having high reliability to minimize failures of the machine during night time hours when service would be inconvenient or unavailable. These advantages are obtained while at the same time permitting a secure compartment designed for use in a lobby or through the wall installation to be used on a narrow island between drive up lanes. A further advantage is that the user panel through which a user of the machine deposits envelopes or receives money need not be substantially modified and therefore the entrance openings will be found in the same general orientations as the user finds them in through the wall or lobby teller machines which the user operates at other installations of the financial institution.

These and other advantages of the invention are accomplished by transporting the documents which may include deposit envelopes and issued cash, in a carrier. The carrier after receiving the document from a slot in the secure compartment rotates the document through arcs in more than one direction so as to bring the carrier into alignment with the opening in the user panel where the document can be easily and reliably issued to the user. Likewise the invention can be used in the deposit mechanism for receiving a deposit from an opening in the user panel and holding this deposit while the carrier is rotated on more than one axis to place it into alignment with a slot in the safe or secure compartment for reliable deposit. The carrier of the invention having rotation on more than one axis thus allows an automatic teller machine to be installed adjacent to a drive up traffic lane by merely moving the user panel from one end of the machine around to the side of the machine and allowing the carrier to orient the deposited documents and issued money so as to reliably pass through both the opening in the user panel and the narrow slot in the safe or secure compartment. Such a narrow slot in the safe minimizes the risk of attack upon the safe and is required by security and insurance regulations.

DETAILED DESCRIPTION OF PREFERRED EMBODIMENT

Figure 1:
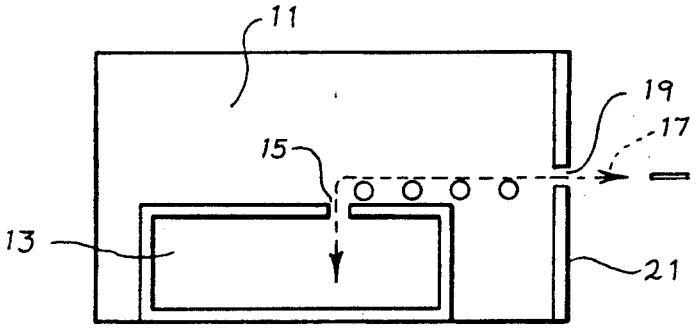
PRIOR ART Fig. 1
FIG. 1 is a side view of a prior art teller machine showing a document path between a user panel opening and safe slot.
Figure 2:
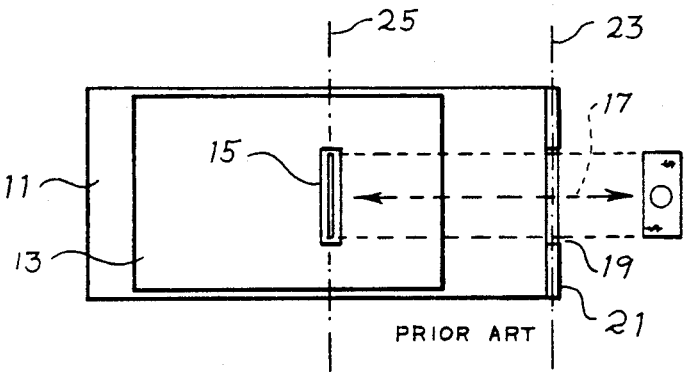
PRIOR ART Fig. 2
FIG. 2 is a top view of this prior art machine showing the same path and the parallel relationship between the slot and opening.

Example configurations of the prior art are shown in FIGS. 1 and 2. FIG. 1 is a side view of a prior art teller machine 11 having a compartment 13 where deposits are stored and where the money issuing mechanism is mounted. Compartment 13 has a slot 15 in its top wall through which the deposits are made and the money is issued. As shown by the dotted line path 17, these financial documents are transported between slot 15 and opening 19 in the face of user panel 21.

FIG. 2 is a top view of the same prior art teller machine 11 with its money path 17. In FIG. 2 the center line 23 of opening 19 in user panel 21 is shown. Likewise the center line 25 of the slot 15 in compartment 13 is clearly visible. It can be seen that these center lines or axis 23. 25 lie parallel to each other so that the financial documents can be transported directly between the slot and the opening without requiring twist or complicated transport paths. So long as the user panel is mounted to one end of the teller machine such convenient path arrangement is possible.

Figure 3:
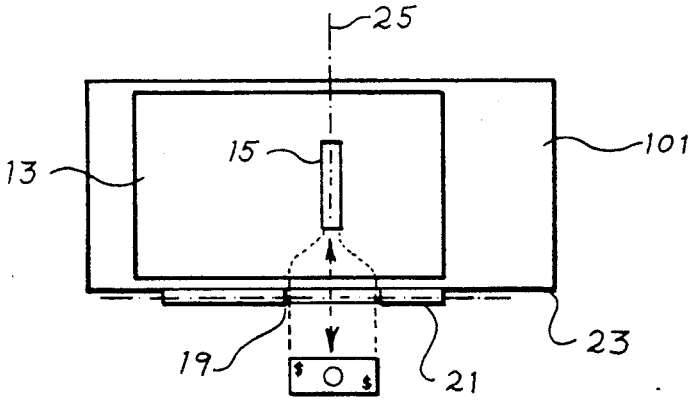
FIG. 3 shows a teller machine according to the invention where the user panel has been moved around to the side of the machine resulting in a transverse relationship between the slot and opening.

Referring now to FIG. 3 a schematic of the preferred embodiment 101 of the invention is shown where the user panel 21 has been moved around to the side of the machine. This allows the machine to be mounted on a narrow island between two lanes of drive up traffic at a bank for example without interfering with traffic in either lane. It can be seen in FIG. 3 that the financial document path is forced to become more complicated because the center line 25 of slot 15 is now transverse to the center line axis 23 of opening 19.

Figure 4:
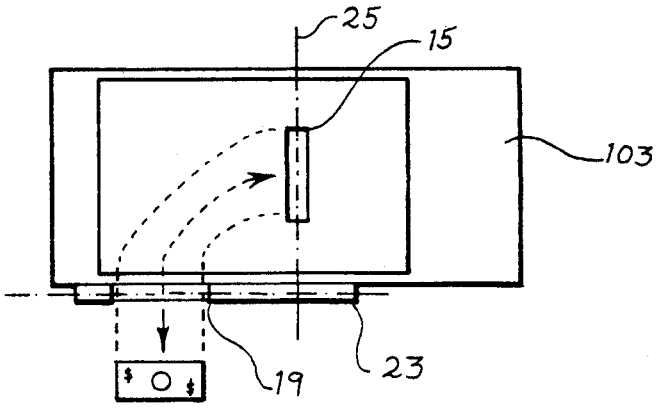
FIG. 4 is a top view of an alternate embodiment according to the invention.

FIG. 4 shows another top view of another embodiment 103 of applicants invention. In this embodiment, the financial document moves through a complex arc as its carrier transports it between opening 19 and slot 15. This arc will be described in more detail with respect to FIGS. 11 through 14.

Figure 5:
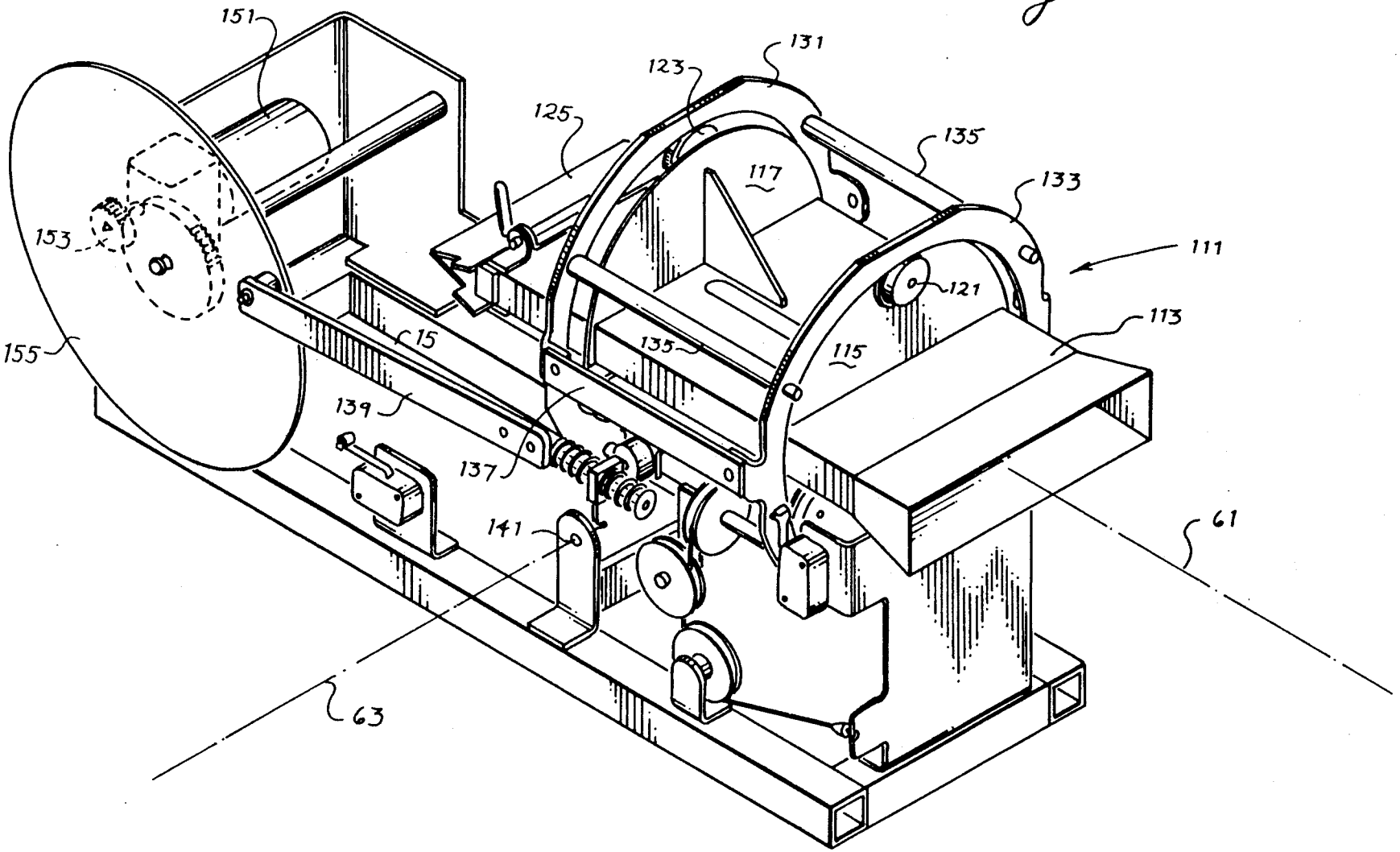
FIG. 5 is a perspective view of a preferred embodiment of the invention in the configuration of FIG. 3.

Referring now to FIG. 5 the preferred embodiment will be described in greater detail. The carrier 111 includes a chute 113 for receiving an envelope for deposit. The chute is mounted to round plates 115 and 117 which are in turn supported on flanged wheels 121 and 123. The carrier also has a gate 125 having two parts which are shown in more detail in FIGS. 9 and 10.

The carrier 111 is supported by its wheels 121 and 123 in a rotary support structure comprising circular tracks 131 and 133 which are held apart by spacer bars 135. In addition bracket 137 is connected to rings 131 and 133. Bracket 137 is connected to connecting rod 139 which acts to tip the support structure about the axis of pin 141. Connecting rod 139 is driven by motor 151 through gear train 153 and drive disk 155. In FIG. 5 the axis of rotation 61 of carrier 111 and the axis of tipping 63 are shown. These axes provide the motion necessary to carry a document between slot 15 and opening 19.

Figure 6:
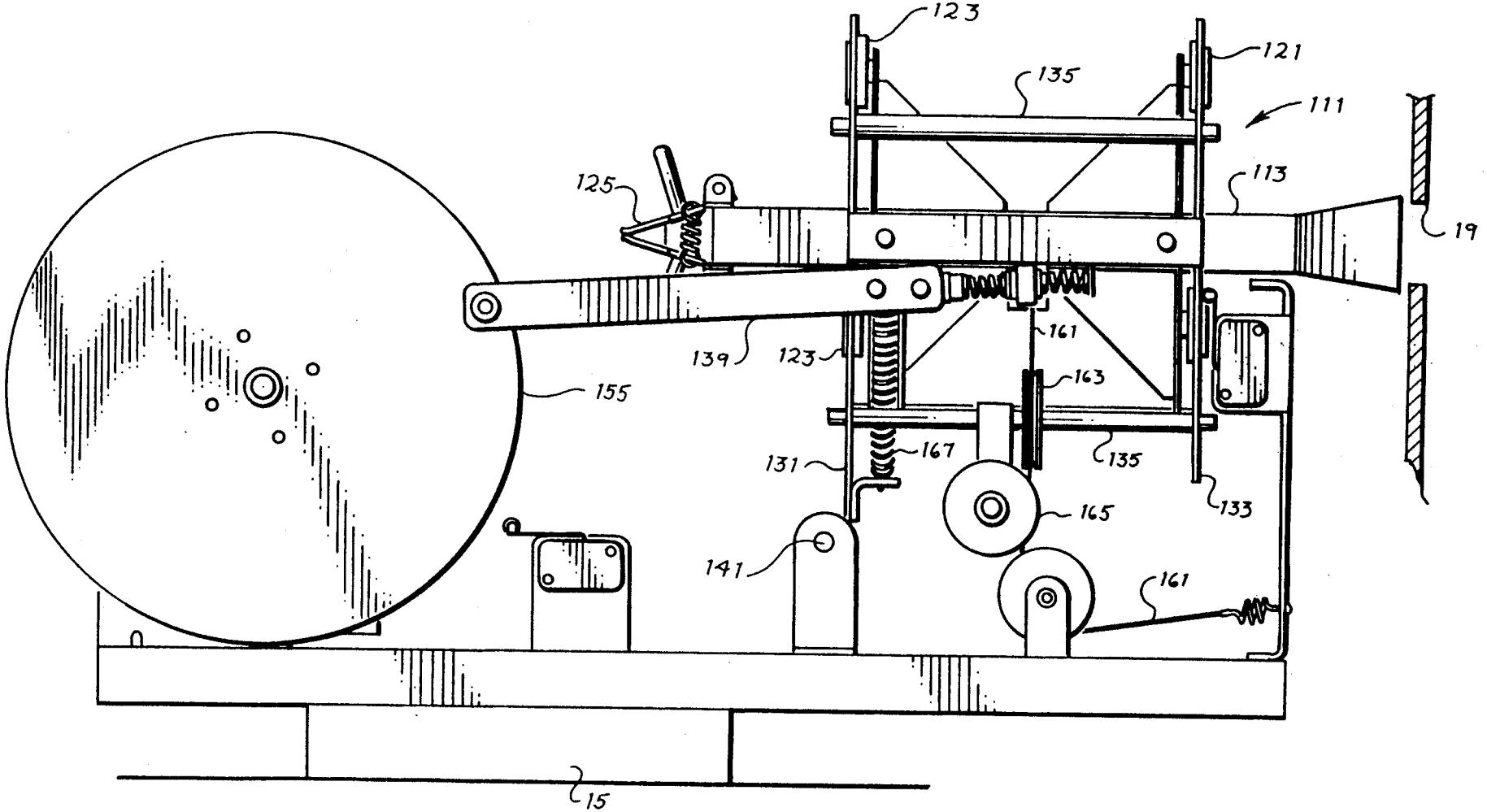
FIG. 6 is a side view of the preferred embodiment in a position to receive a deposit from a user.

Referring now to FIG. 6, a side view of the carrier and its support structure and drive is shown. In FIG. 6, carrier 111 is shown in position to receive an envelope through opening 19. The envelope is received into chute 113 where it is held by gravity while the carrier moves. While connecting rod 139 tips carrier 111 cable 161 fastened to the far side of chute 113 pulls downward on the carrier causing it to rotate on its Wheels 121. 123 while it is being tipped. The downward pull slowly becomes a horizontal pull as cable 161 is guided by pulleys 163 and 165 which are fixed to one of the spacer bars 135. Return spring 167 keeps the carrier in tension against the pull of cable 161. After the deposit has been made and disk 155 completes its rotation, return spring 167 restores the carrier 111 to the position shown in FIG. 6.

Figure 7:
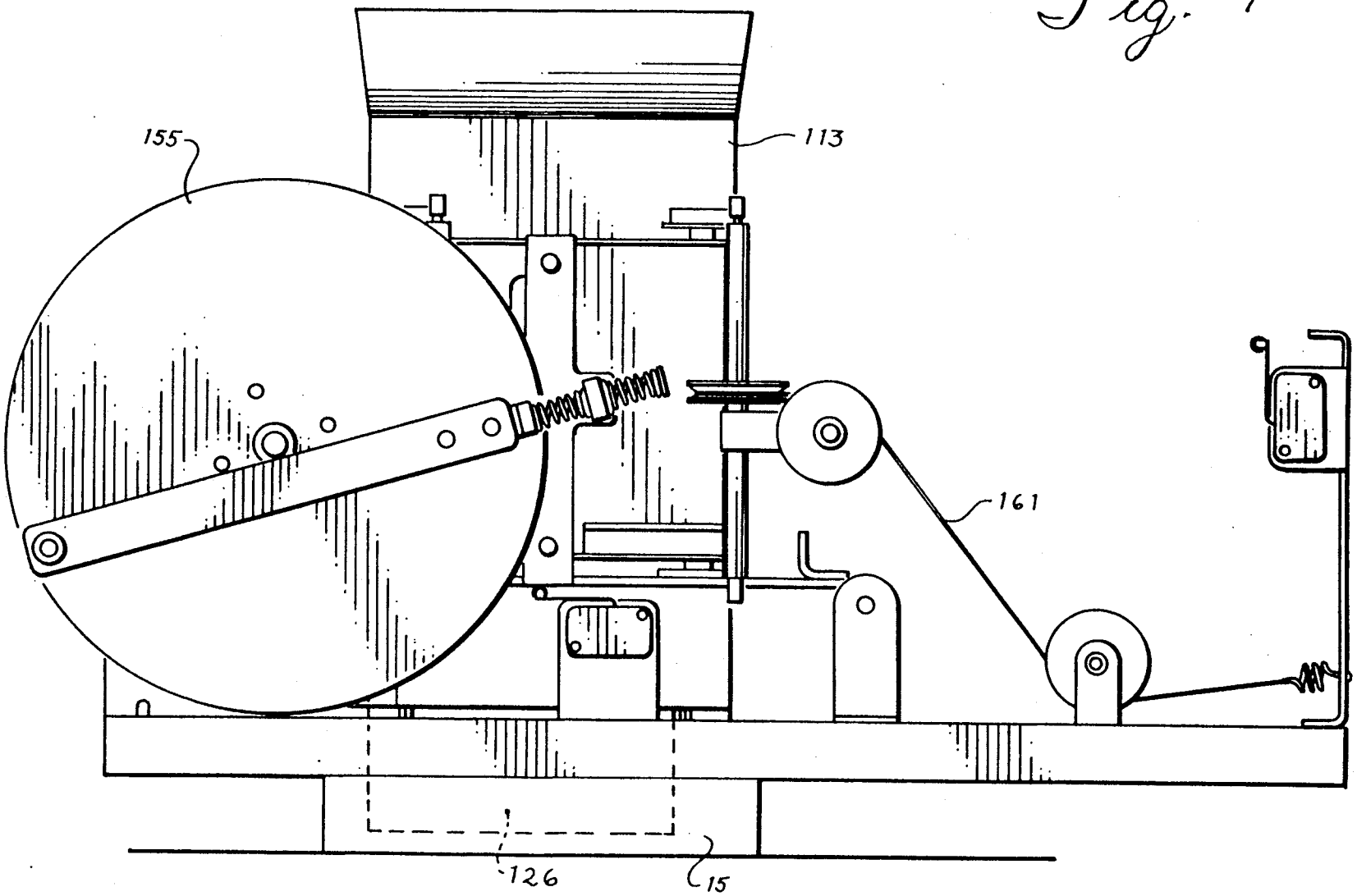
FIG. 7 is another side view of the preferred embodiment after the carrier has been rotated and tipped to release the deposit into a secure compartment.

Referring now to FIG. 7, the carrier of FIGS. 5 and 6 is shown in the position to release a document which has been rotated and tipped into position to pass through slot 15 in compartment 13.

Figure 8:
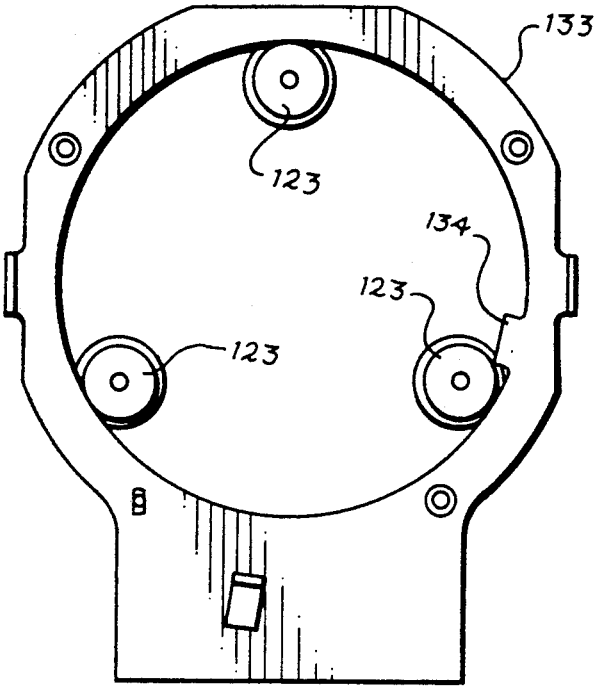
FIG. 8 shows an end view of the support for the carrier of FIGS. 6 and 7.

FIG. 8 is an end view of the support assembly showing the support ring 133 and flanged wheels 123. Support ring 133 has a stop 134 which is engaged by one of the wheels 123 so as to stop rotation of the carrier when it has come into position for alignment with slot 15.

Figure 9:
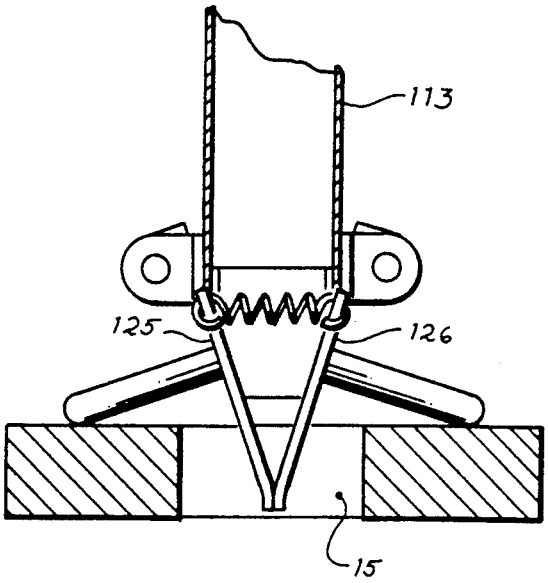
FIG. 9 shows the release mechanism of the carrier just prior to release of a deposit.

FIG. 9 shows the chute 113 of the carrier in position over slot 15 just prior to releasing the documents contained therein.

Figure 10:
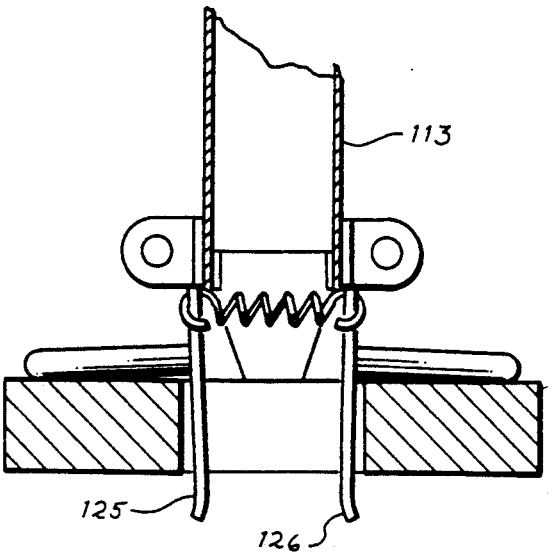
FIG. 10 shows the release mechanism of the carrier after releasing a deposit.

FIG. 10 shows the same carrier chute 113 after the support assembly has tipped an additional amount so as to cause the arms on gates 125. 126 to release the documents.

Figure 11:
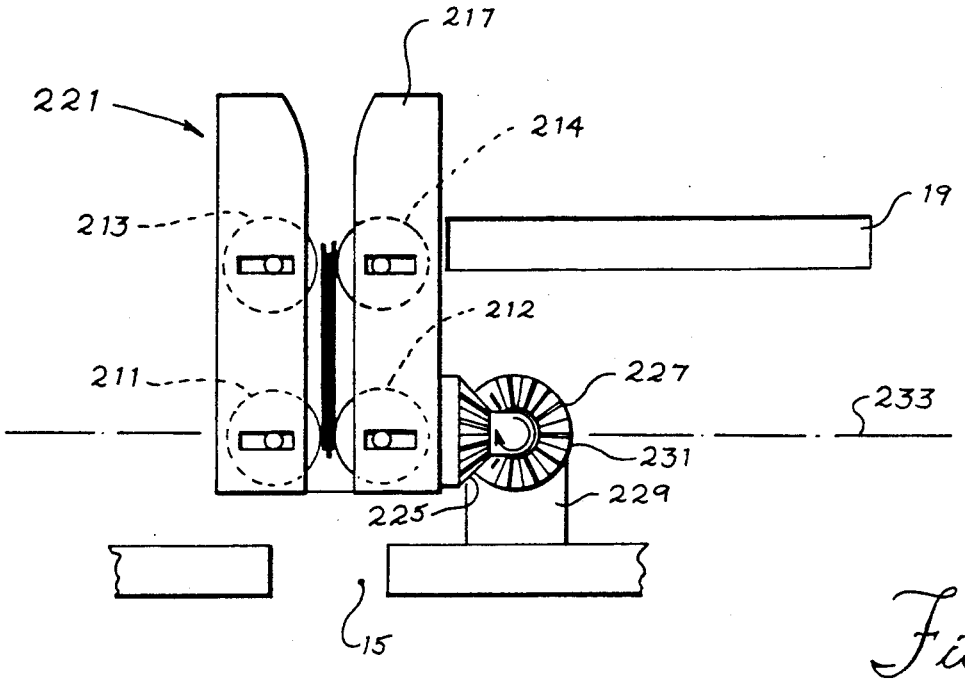
FIG. 11 is a side view of an alternate embodiment of the carrier according to the invention.
Figure 12:
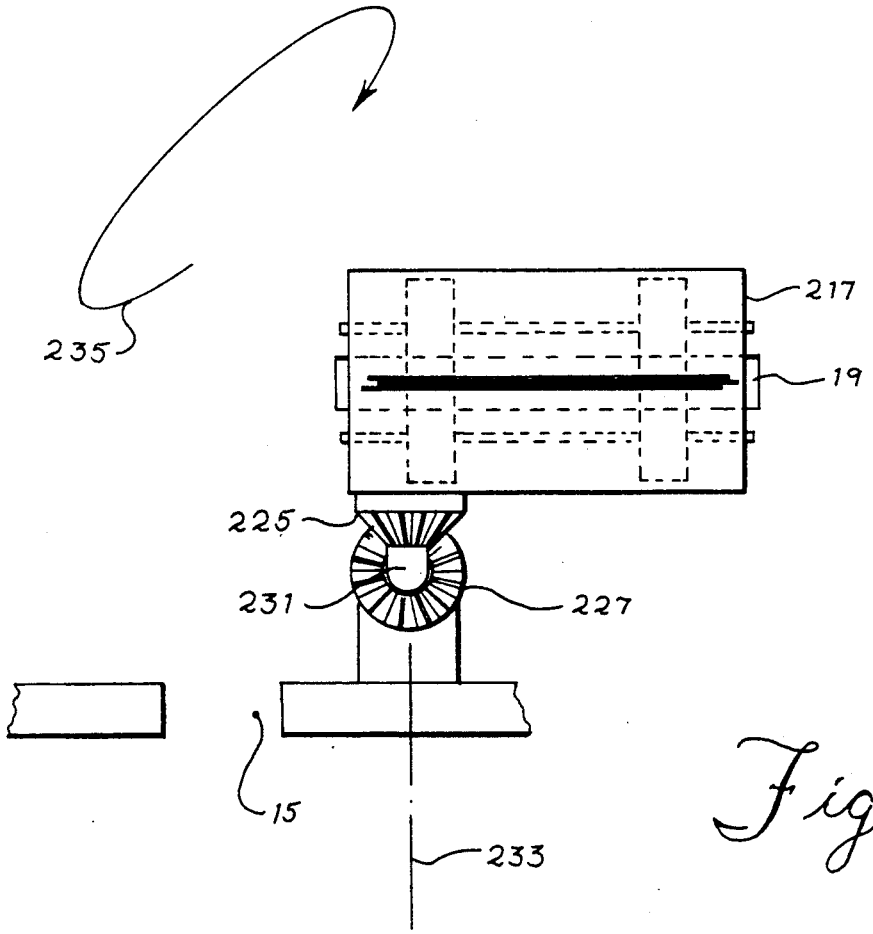
FIG. 12 is another side view wherein the carrier has been rotated and pivoted into position with the opening in the user panel.

Referring now to FIG. 11 a view from the rear of the machine looking forward is set forth depicting an alternate embodiment of the invention. In this embodiment, a cash carrier is disclosed for transporting a bundle of cash which has been issued by an issue mechanism within compartment 13. The bundle of cash is accumulated and transported upward out of compartment 13 through slot 15 into the nip of rolls 211, 212, and 213, 214 where it is held. Rolls 211 through 214 are part of carrier 221 which is mounted to a bevel gear 225. The bevel gear 225 is permanently fixed and a part of carrier 221. Carrier 221 and its attached bevel gear 225 are mounted on a spindle passing directly through bevel gear 225 for rotation as bevel gear 225 meshes and moves cross the face of bevel gear 227. Bevel gear 227 is likewise fixedly attached to support 229 which is mounted directly to the top wall of compartment 13. Passing through bevel gear 227 is a shaft 231 which is driven by a motor through approximately 90 degrees causing carrier 221 to moVe from a position in front of slot 15 to a position in front of opening 19. While shaft 231 is driven, bevel gears 225 and 227 interact with each other causing carrier assembly 221 to rotate approximately 90 degrees around the axis 233 so that its side plate 217 which appears in FIG. 11 in full view of the observer is translated to the side position at the right shown in FIG. 12. In this way carrier 221 moves with two forms of rotation, a first form of rotation around axis 233 and a second form of rotation around shaft 231 as it is driven by a motor which is not shown. Each of the details shown in FIGS. 5 through 10 may have a counterpart in the embodiment of FIGS. 11 and 12 but they have been omitted from these figures in order to avoid duplication. The combination of rotation about axis 233 and shaft 231 is depicted schematically by arrow 235.

Figure 13:
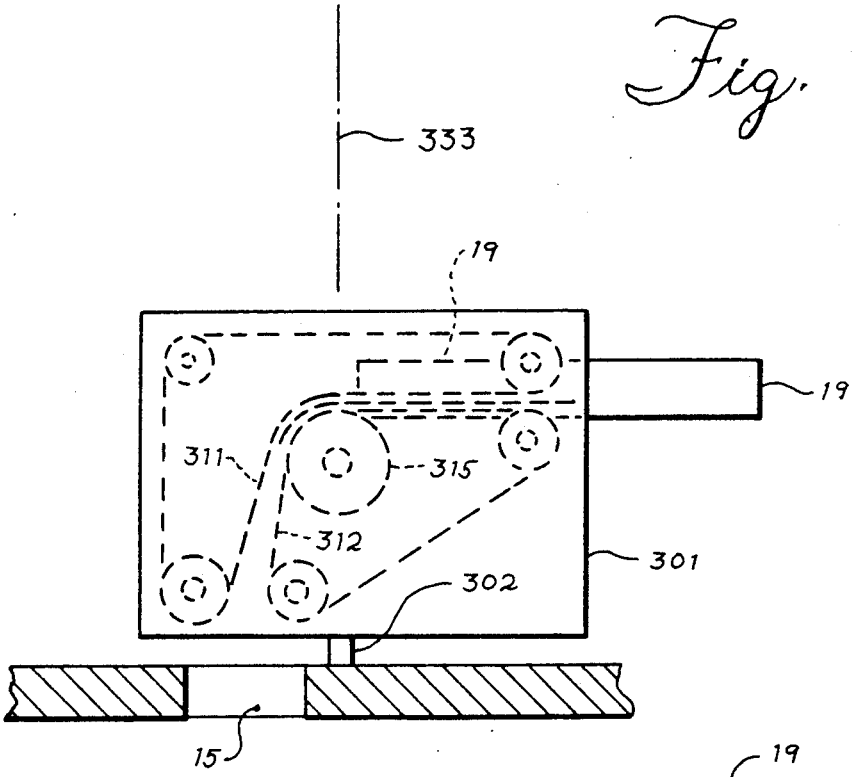
FIG. 13 is a side view of a third embodiment of the invention corresponding to FIG. 11.
Figure 14:
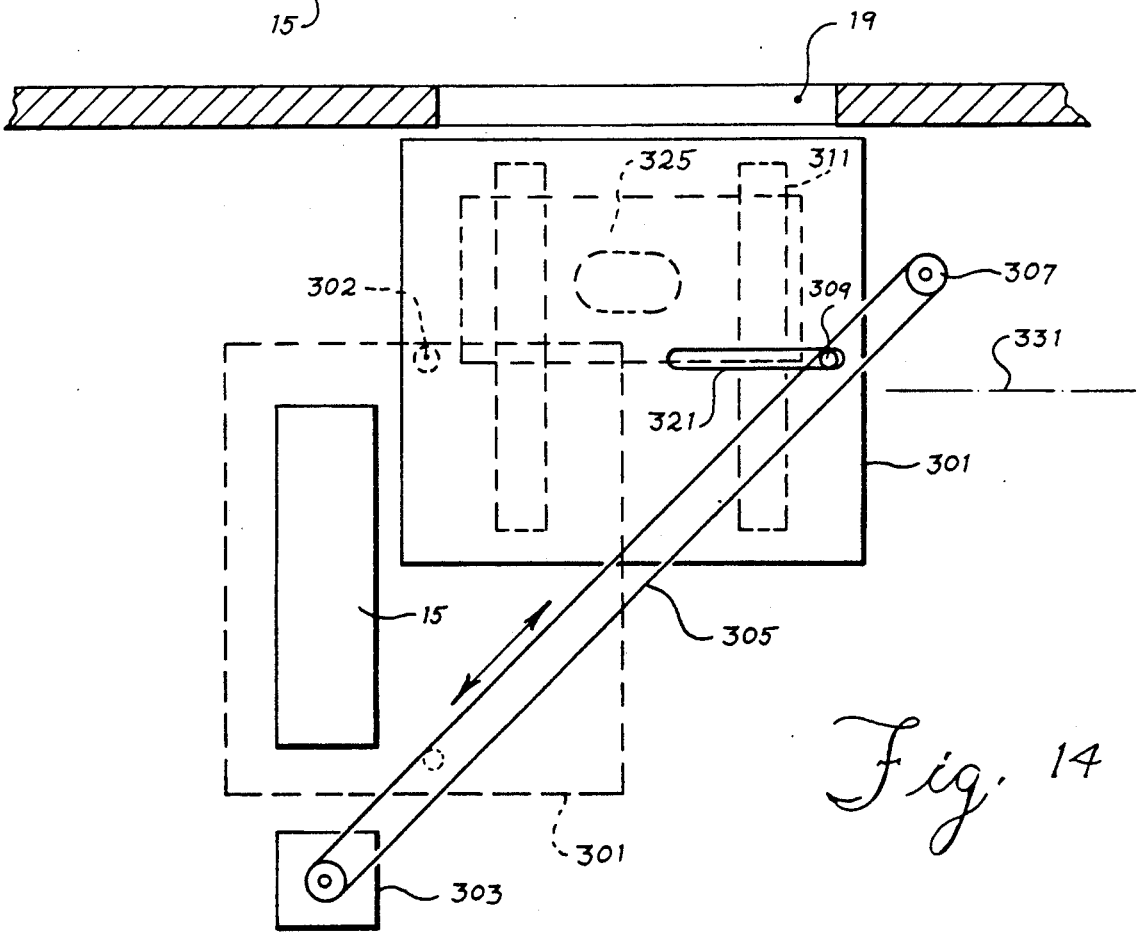
FIG. 14 is a top view of the third embodiment.

Referring now to FIG. 13 another embodiment of the invention in the form of a carrier for moving documents between slot 15 and opening 19 is set forth. In this embodiment documents are again collected by a document issuing mechanism and fed upward through slot 15 into the nip between belts 311 and 312. As they are fed between belts 311 and 312, they rotate about roll 315 from a vertical into a horizontal plane. After the documents have been captured between belts 311 and 312, carrier 301 is rotated about pivot 302 into proximity with opening 19. this rotation is better shown in FIG. 14 which is a top view of the carrier 301 shoWn in position in front of opening 19. Slot 15 is also shown. Carrier 301 is shown in dotted lines over slot 15 whereas it is shown in solid lines in front of opening 19. The mechanism for moving carrier 301 includes motor 303 which drives belt 305 around pulley 307. Belt 305 has a pin 309 fastened to it. Pin 309 slides in a slot 321 in the top surface of carrier 301. As motor 303 drives clockwise, the carrier 301 is moved from proximity of slot 15 to its position in front of opening 19. Later motor 303 is driven counterclockwise to return carrier 301 back to its position over slot 15. In FIG. 14 some money 325 is shown in dotted lines ready to be driven out through opening 19. While moving money between slot 15 and opening 19, carrier 301 causes it to rotate about axis 331 which is the shaft of roll 315 and also causes it to rotate about axis 333 which is the pivot upon which carrier 301 is rotated by motor 303. Roll 315 is also driven by motor not shown to move the bank notes or money 325 into and out of carrier 301.

While the invention has been described with reference to a preferred embodiment and two alternate embodiments, it will be recognized by those skilled in the art that features of each may be combined with the others to provide a depository in the form shown in the FIGS. 13 and 14 or a money issuing mechanism in the form shown by FIGS. 5 through 10. To accomplish such changes, the rolls or belts of FIGS. 11 through 14 would be mounted in chute 113 of FIGS. 5 through 10 to positively control the documents instead of relying upon gravity as is the case with an envelope depository. Each of these embodiments and other modifications which will suggest themselves to those skilled in the art accomplish the transfer of financial documents between a slot 15 in a secure compartment and an opening 19 in a user panel of the teller machine.

Having thus described the invention, what is claimed is:

1. A transaction machine for handling financial documents comprising:

a compartment for enclosing a plurality of said documents;

a slot in said compartment permitting passage of said documents between the interior and exterior of said compartment, said slot having a length which is longer than a width of said slot, an axis of said slot passing through ends of said slot and lying along said length of said slot;

a user panel having an opening for passing ones of said documents between said transaction machine and a user of said machine, said opening being longer than said opening is wide, an axis of said opening passing through ends of said opening and lying along said length of said opening, said axis of said opening being transverse to said axis of said slot;

a document transport for transporting a document between said slot and said opening, said transport having a carrier for receiving said document; means for imparting to said carrier, rotation around a first axis and rotation around a second axis transverse to said first axis to permit said carrier to orient said document for passage through said slot and for passage through said opening.

2. A transaction machine having a user panel and a safe for storing documents, said machine comprising:

a slot in a wall of said safe, said slot allowing passage of ones of said documents through said wall, said slot having a length which is longer than a width of said slot, an axis of said slot passing through ends of said slot and lying along said length of said slot;

an opening in said user panel, said opening allowing passage of ones of said documents between said machine and a user of said machine, said opening being longer than said opening is wide, an axis of said opening passing through ends of said opening and lying along said length of said opening, said axis of said opening being transverse to said axis of said slot;

means for carrying documents between said slot and said opening, said means for carrying comprising:

a document carrier for receiving and holding a document;

means for rotating said carrier holding said document about an axis, said axis being substantially perpendicular to said axis of said slot;

whereby a document being carried by said carrier is oriented by said carrier to pass through said slot at one end of the travel of said carrier and to pass through said opening at another end of said travel of said carrier.

3. The transaction machine of claim 2 wherein said carrier further comprises:

means within said carrier for rotating said document about a second axis, said second axis being substantially perpendicular to said axis of rotation of said carrier.

4. The transaction machine of claim 3 wherein said means within said carrier for rotating said document about said second axis comprises rollers and guides.

5. The transaction machine of claim 3 wherein said means within said carrier for rotating said document about said second axis comprises a document holder which is itself rotated within said carrier.

6. The transaction machine of claim 3 wherein said second axis is substantially perpendicular to said axis of said slot at said one end of said travel of said carrier and is substantially parallel to said axis of said slot at said another end of said travel of said carrier.

7. The transaction machine of claim 3 wherein said second axis is substantially parallel to said axis of said slot at said one end of said travel of said carrier and is substantially parallel to said axis of said opening at said another end of said travel of said carrier.

* * * * *